US008934213B2

(12) United States Patent
Froom et al.

(10) Patent No.: US 8,934,213 B2
(45) Date of Patent: Jan. 13, 2015

(54) ELECTROSHOCK ACCESSORY FOR MOBILE DEVICES

(71) Applicant: Yellow Jacket, LLC, Baton Rouge, LA (US)

(72) Inventors: Seth A. Froom, Baton Rouge, LA (US); Trevor Reeves, Baton Rouge, LA (US)

(73) Assignee: Yellow Jacket, L.L.C., Baton Rouge, LA (US)

( * ) Notice: Subject to any disclaimer, the term of this patent is extended or adjusted under 35 U.S.C. 154(b) by 154 days.

(21) Appl. No.: 13/662,256

(22) Filed: Oct. 26, 2012

(65) Prior Publication Data

US 2013/0279065 A1 Oct. 24, 2013

Related U.S. Application Data

(60) Provisional application No. 61/709,968, filed on Oct. 4, 2012, provisional application No. 61/625,941, filed on Apr. 18, 2012.

(51) Int. Cl.

| | |
|---|---|
| ***F41B 15/04*** | (2006.01) |
| ***H01T 23/00*** | (2006.01) |
| ***F41H 13/00*** | (2006.01) |

(52) U.S. Cl.

CPC ..... *F41H 13/0025* (2013.01); *F41H 13/0018* (2013.01)

USPC ..... 361/232

(58) Field of Classification Search

USPC ..... 361/232

See application file for complete search history.

(56) References Cited

U.S. PATENT DOCUMENTS

| | | | |
|---|---|---|---|
| 4,186,851 | A | 2/1980 | Cantor |
| 4,446,990 | A | 5/1984 | Stevenson et al. |
| 4,624,389 | A | 11/1986 | Ang |
| 4,688,140 | A | 8/1987 | Hammes |
| 4,982,645 | A | 1/1991 | Abboud |
| D343,172 | S | 1/1994 | Watanabe |
| D350,744 | S | 9/1994 | Hino |
| 5,422,656 | A | 6/1995 | Allard et al. |
| 5,429,301 | A | 7/1995 | Franks |
| 5,446,789 | A | 8/1995 | Loy et al. |
| 5,476,192 | A | 12/1995 | Julinot |
| 5,531,359 | A | 7/1996 | Winner |
| 5,578,992 | A | 11/1996 | Harding |
| 5,635,908 | A | 6/1997 | Soper |
| 5,781,114 | A | 7/1998 | Chang |
| 5,973,477 | A | 10/1999 | Chang |
| 5,988,450 | A | 11/1999 | Cassarino |

(Continued)

FOREIGN PATENT DOCUMENTS

| | | |
|---|---|---|
| KR | 1020110068190 | 6/2011 |
| TW | 201119332 | 6/2011 |

*Primary Examiner* — Dharti Patel

(74) *Attorney, Agent, or Firm* — Roy Kiesel Ford Doody & Thurman, APLC

(57) ABSTRACT

The technologies disclosed herein introduce an electroshock weapon system for a mobile device. The system can discharge electrical energy as intended to be used as a means of self-defense. In one embodiment, the apparatus includes a housing, an electroshock module and a battery. The housing has a shape adapted to secure to the mobile device, and the electroshock module and battery are positioned inside the housing. The electroshock module is configured to release an electric shock. The battery is configured to supply electrical power to the electroshock module and, optionally, the mobile device.

27 Claims, 16 Drawing Sheets

(56) References Cited

U.S. PATENT DOCUMENTS

| | | | | |
|---|---|---|---|---|
| 6,043,626 | A * | 3/2000 | Snyder et al. | 320/113 |
| 6,535,127 | B1 | 3/2003 | Taylor | |
| 6,580,908 | B1 | 6/2003 | Kroll et al. | |
| 6,635,975 | B2 | 10/2003 | Hsieh et al. | |
| 6,636,412 | B2 | 10/2003 | Smith | |
| 6,785,566 | B1 | 8/2004 | Irizarry | |
| 6,980,777 | B2 | 12/2005 | Shepherd et al. | |
| 7,057,872 | B2 | 6/2006 | Smith et al. | |
| 7,075,770 | B1 | 7/2006 | Smith | |
| 7,102,870 | B2 | 9/2006 | Nerheim | |
| 7,143,539 | B2 | 12/2006 | Cerovic et al. | |
| 7,145,762 | B2 | 12/2006 | Nerheim | |
| 7,158,362 | B2 | 1/2007 | Smith | |
| 7,218,077 | B2 | 5/2007 | Nerheim | |
| 7,280,340 | B2 | 10/2007 | Smith et al. | |
| 7,336,472 | B2 | 2/2008 | Nerheim et al. | |
| 7,400,917 | B2 | 7/2008 | Wood et al. | |
| 7,457,096 | B2 | 11/2008 | Brundula | |
| 7,457,636 | B2 | 11/2008 | Kroll et al. | |
| 7,483,715 | B2 * | 1/2009 | Kroll et al. | 455/550.1 |
| 7,580,237 | B2 | 8/2009 | Nerheim | |
| 7,602,598 | B2 | 10/2009 | Nerheim | |
| 7,805,158 | B2 | 9/2010 | Kroll et al. | |
| 7,821,766 | B2 | 10/2010 | Brundula | |
| 7,986,506 | B2 | 7/2011 | Brundula | |
| 7,986,965 | B2 | 7/2011 | Kroll et al. | |
| 8,028,794 | B1 | 10/2011 | Freeman | |
| 8,253,371 | B2 * | 8/2012 | Vitanov et al. | 320/103 |
| 8,472,915 | B2 | 6/2013 | Di Perna et al. | |
| 2002/0041479 | A1 | 4/2002 | Hsieh et al. | |
| 2006/0201964 | A1 | 9/2006 | DiPerna et al. | |
| 2010/0231776 | A1 | 9/2010 | Li et al. | |
| 2013/0092565 | A1 * | 4/2013 | Swope | 206/216 |
| 2013/0244724 | A1 | 9/2013 | Monti et al. | |

* cited by examiner

ELECTROSHOCK ACCESSORY FOR MOBILE DEVICES

CROSS REFERENCE TO RELATED APPLICATIONS

This application claims priority to U.S. Provisional Application No. 61/709,968 entitled ELECTROSHOCK ACCESSORY FOR MOBILE DEVICES, filed Oct. 4, 2012, and U.S. Provisional Application No. 61/625,941 entitled ELECTROSHOCK WEAPON SYSTEM SMARTPHONE DEVICE CASE, filed Apr. 18, 2012, both of which are hereby incorporated by reference in their entireties.

FIELD

This disclosure relates generally to mobile device accessories, and in particular to accessories containing modules providing additional battery capacity and self-defense hardware functionalities for mobile devices.

BACKGROUND

Every year many people are robbed, assaulted, attacked or otherwise find themselves victims of violent crimes. Such crimes include robbery, armed robbery, assault, aggravated assault, assault with a deadly weapon, battery, aggravated battery, manslaughter, 1st, 2nd and 3rd degree murders, and rape. These crimes deprive victims of possessions, and place them in physical harm, immediate danger, and traumatizing situations. For example, victims of sexual assault and extremely violent crimes may never fully recover. Humans have an instinctual natural desire to feel safe and stay free from any potential threat. However in modern day society as population and uncertainty increase, the number of violent crimes increase as well. According to the U.S. Census Bureau, 231,589,260 people were victims of crimes in the United States in 2002.

Many people with mobile devices (e.g. smart phones) are viewed by violent offenders as easy targets with expendable income, thus making them more likely to run into a harmful situation while walking to and from a college class, the library, the grocery store, the mall, local hang-out areas, a bar/club, an empty street/alley or anywhere else that they may be traveling to or from. In these situations, self-defense capability can mean the difference between life and death.

There are a number of self-defense devices and mechanisms currently available on the market, including pepper spray, tear gas, dyes, and personal alarms. There are a number of drawbacks associated with current self-defense devices. One drawback is that people frequently forget to take the device with them and therefore have no access to the device in dangerous situations. Another drawback is the inability to access a defense system quickly enough to respond to an unexpected attack.

SUMMARY

One object of this disclosure is to describe a means of self-defense that a person is not likely to leave behind and is quickly accessible. It is also an object of this disclosure to describe an electroshock weapon system capable of incapacitating an aggressive attacker, giving the victim time to escape. Another object of the disclosure is to describe a device that provides moderate protection to the smartphone device due to damage associated with drops or collisions.

The technologies disclosed herein introduces an apparatus for a mobile device. The apparatus includes a housing, an electroshock module and a battery. The housing has a shape adapted to secure the mobile device to the housing. The electroshock module within the housing is configured to release an electric shock. The battery within the housing is configured to supply electrical power to the electroshock module and the mobile device.

A mobile device can include any kind of device that is portable, such as a cellular telephone, e.g. an iPhone or an Android phone, an iPod, a touch screen device, e.g. an iPad, or any type of portable device that has a processor and a memory.

It is common that people carry their smart phones almost everywhere they go. By carrying their smart phones which fit into a case incorporating an electroshock weapon system, people have a means of self-protection capable of stopping attackers. The electroshock weapon system attached to the smart phone is a self-defense device that is easy to use, quick to access, non-lethal and effective. The system increases the safety and security of a person who finds himself/herself in a dangerous situation. The case also covers a user's mobile device and helps to prevent the mobile device from incurring damage due to drops or collisions.

Other aspects of the technology introduced here will be apparent from the accompanying figures and from the detailed description which follows.

BRIEF DESCRIPTION OF THE DRAWINGS

These and other objects, features and characteristics of the present disclosure will become more apparent to those skilled in the art from a study of the following detailed description in conjunction with the appended claims and drawings, all of which form a part of this specification. In the drawings:

DETAILED DESCRIPTION

References in this description to "an embodiment", "one embodiment", or the like, mean that the particular feature, function, or characteristic being described is included in at least one embodiment of the present disclosure. Occurrences of such phrases in this description do not necessarily all refer to the same embodiment, nor are they necessarily mutually exclusive.

Figure 1A:
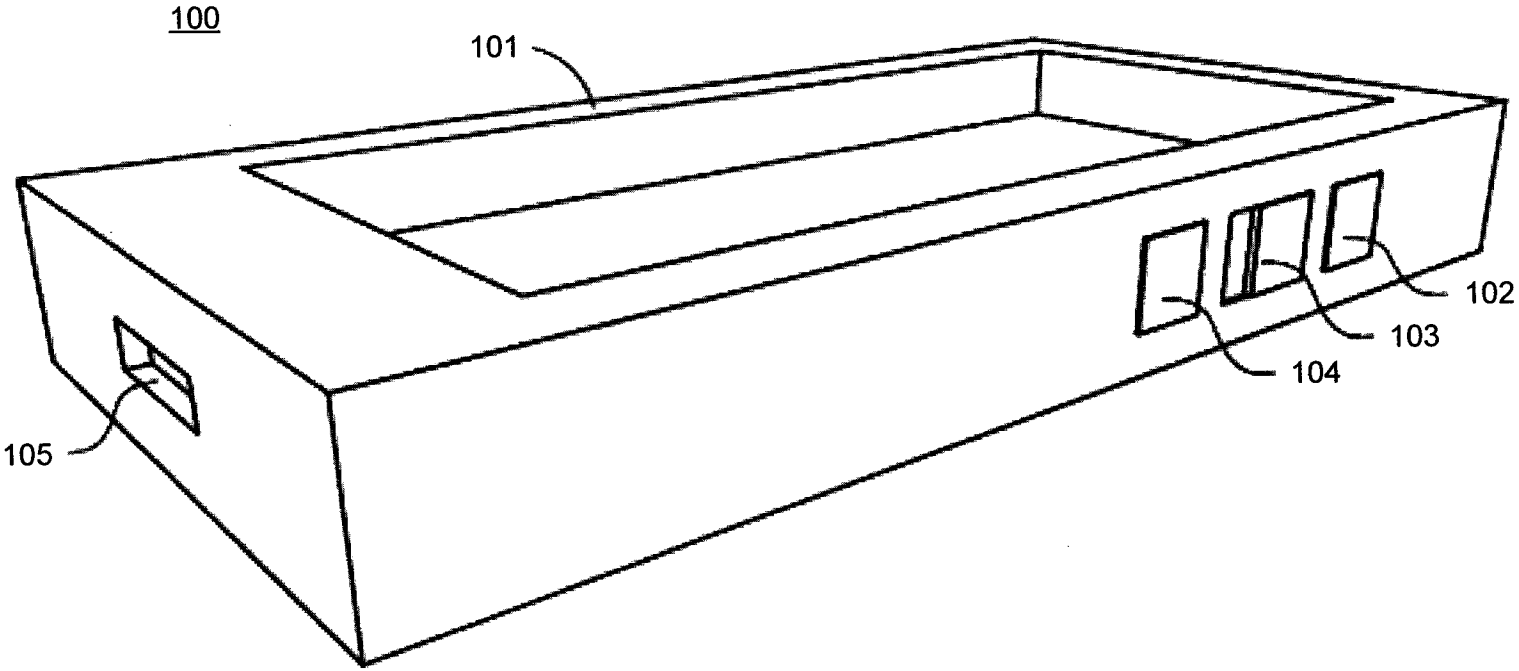
FIGS. 1A and 1B illustrate a device according to one embodiment of the present disclosure.
Figure 1B:
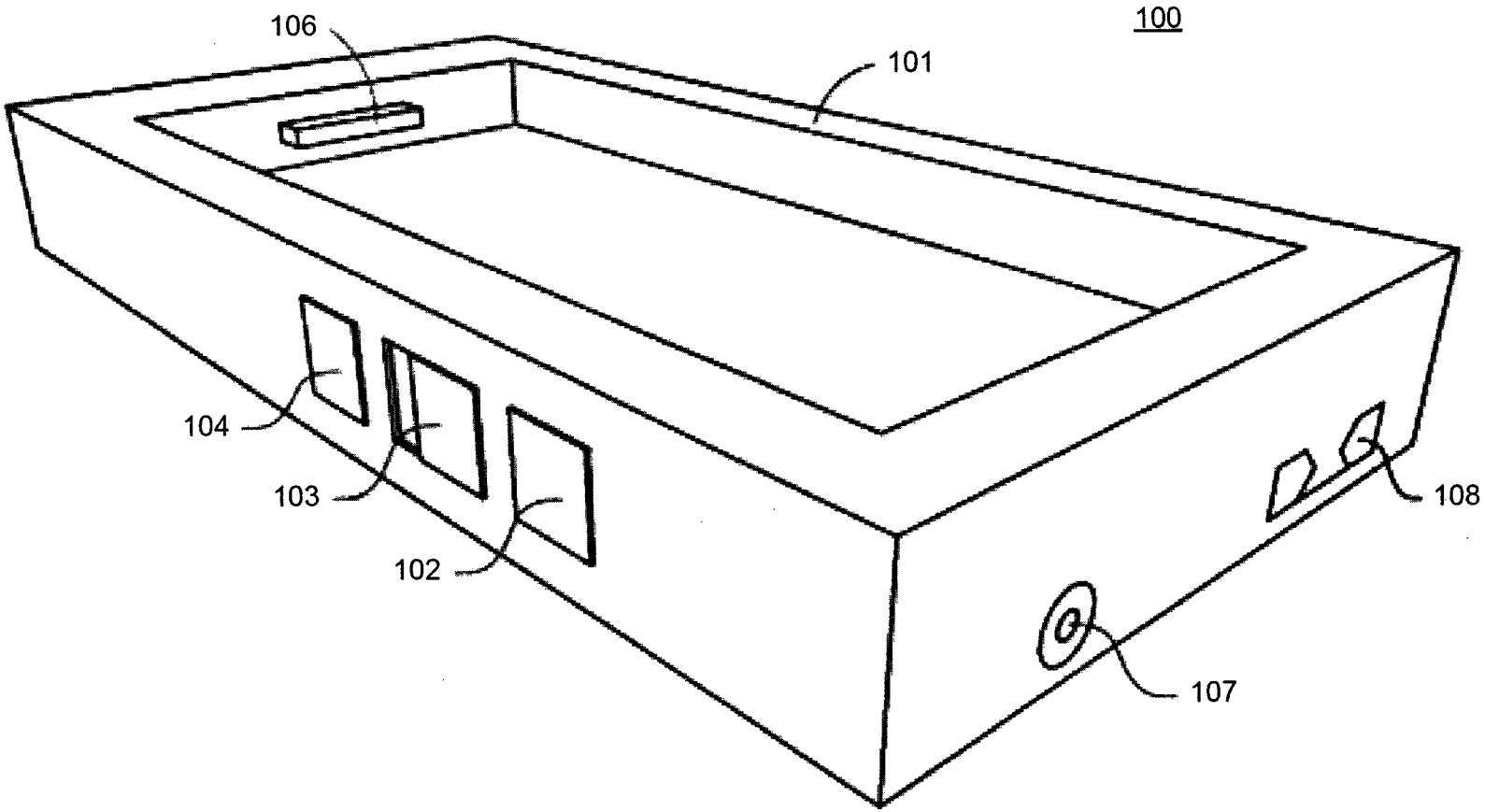

FIGS. 1A and 1B illustrate a device 100 according to one embodiment of the present disclosure. FIG. 1A is a perspective view of the device 100 as seen from the front, bottom, right side. FIG. 1B is a perspective view of the device 100 as seen from the front, top, right side. In one embodiment, the device 100 includes a housing 101 (also referred to as a case), an activation button 102, a safety switch 103, a flashlight power button 104, a power charger interface 105, a mobile device interface 106, a flashlight 107, and electrodes 108.

The housing 101 can be made of plastic, metal, or other type of materials as contemplated by a person having ordinary skill in the art. The shape of the housing 101 can be adapted for a mobile device so that a mobile device can fit and be secured into the housing 101. A mobile device can be a smart phone, a video game console, a tablet, a laptop, or other types of portable electronic devices.

In one embodiment, the housing 101 is designed specifically for a particular mobile device model. Mobile devices fit into their respective designated form fitted housings integrated with electroshock weapon systems.

The device 100 includes a battery (not shown) within the housing 101 that can be charged from a power source through the power charger interface 105. In one embodiment, the device 100 is charged using the same charger designed to charge the mobile device which fits into the device 100. In another embodiment, the device 100 is charged with a standard charger. When the mobile device is secured into the device 100, the mobile device interface 106 is connected to the mobile device. In some other embodiments, the mobile device can also be charged through its power charger interface 105 when the mobile device is secured within the device 100.

The device 100 includes an electroshock self-defense weapon system in the housing 101. In one embodiment, when a user pushes the safety switch 103 to an "on" position, the electroshock self-defense weapon system starts to charge. Once the user presses the activation button 102, the electroshock self-defense weapon system starts to deliver electroshock through the electrodes 108. These electrodes 108 emit an electrical charge that is capable of incapacitating an attacker. In one embodiment as illustrated in FIG. 1B, the electrodes 108 are exposed. In some other embodiments, the electrodes may have a cap, shield, cover, or other protective element placed on top of the electrodes. This protective element may be permanently attached to the case or may be removable.

In addition, in one embodiment, the device 100 can include a flashlight 107 and a flashlight button 104. The user can turn on the flashlight 107 by clicking the flashlight button 104. In one embodiment, the flashlight can be powered by a battery within the housing 101.

Figure 2A:
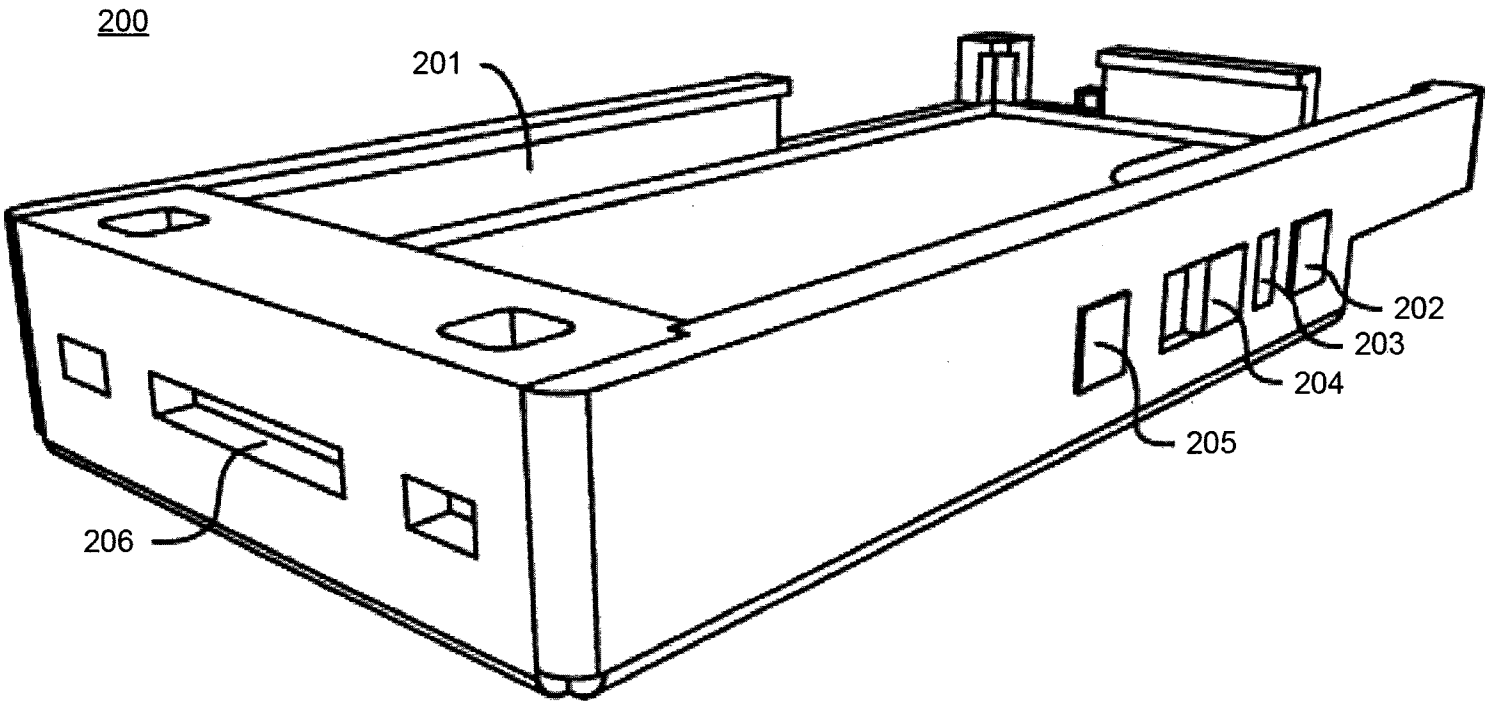
FIGS. 2A, 2B and 2C illustrate a device according to another embodiment of the present disclosure.
Figure 2B:
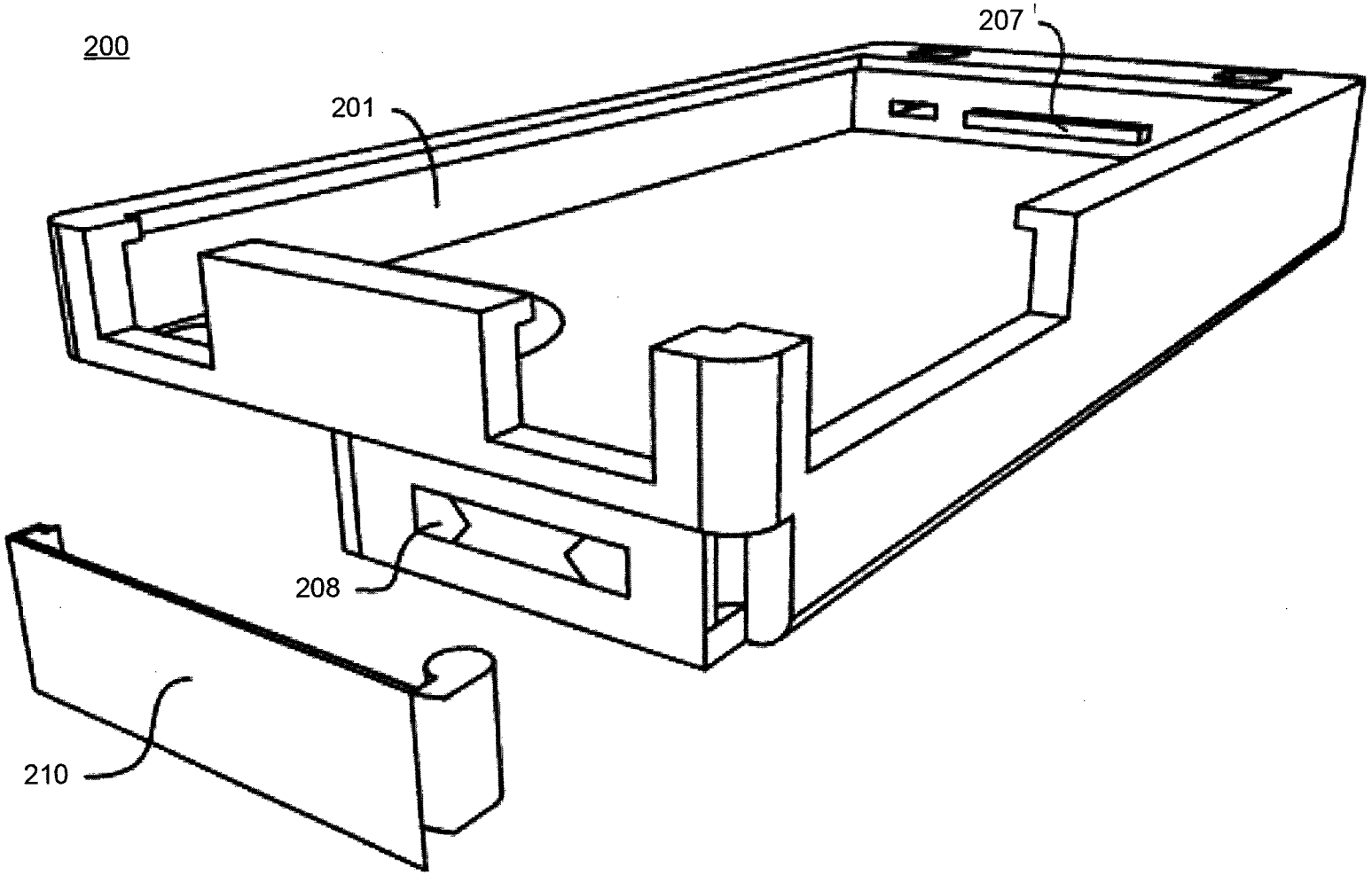
Figure 2C:
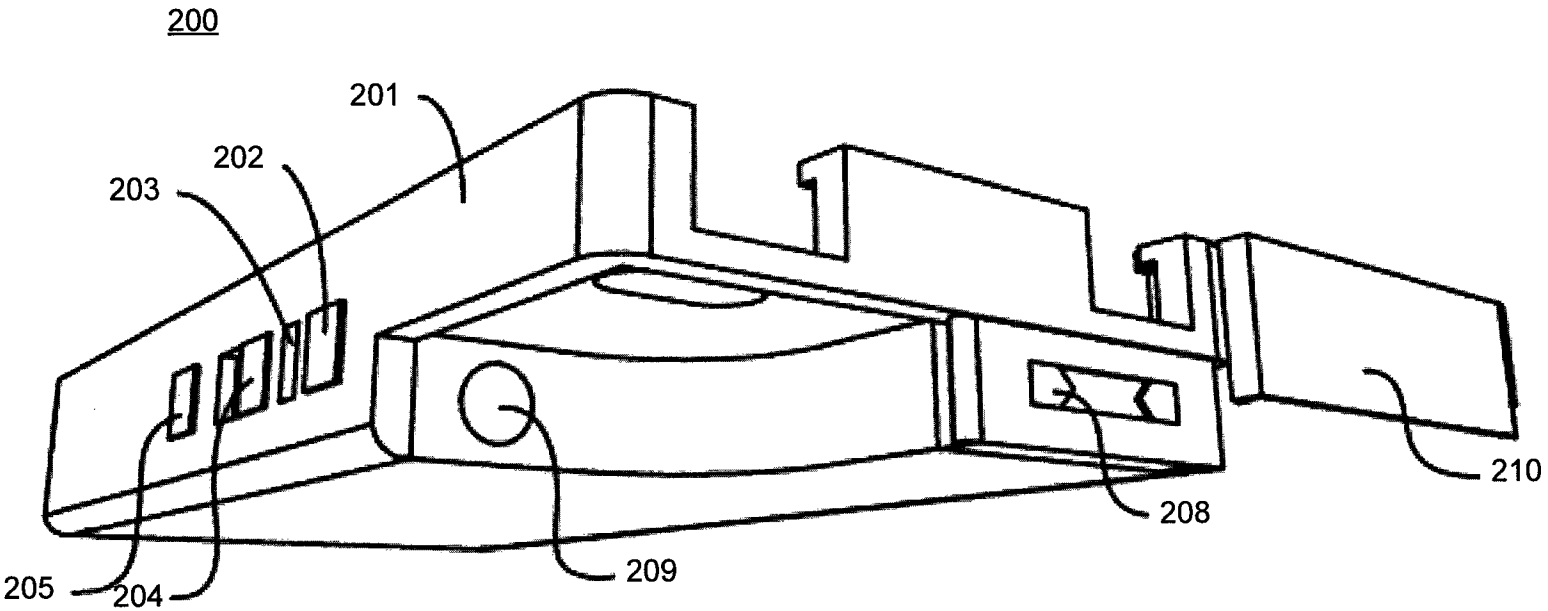

FIG. 2A illustrates a device 200 according to another embodiment of the present disclosure. FIGS. 2B and 2C illustrate additional views of the device 200 which is illustrated in FIG. 2A. FIG. 2B is a perspective view of the device 200 as seen from the front, top, left side. FIG. 2C is a perspective view of the device 200 as seen from the back, top, right side. FIG. 2A is a perspective view of the device 200 as seen from the front, bottom, right side. In one embodiment, the device 200 includes a housing 201 (also referred to as a case), an activation button 202, an LED light 203, a safety switch 204, a flashlight power button 205, a power charger interface 206, a mobile device interface 207, electrodes 208, a flashlight 209, and an electrode cap 210.

The device 200 can work as both a mobile device case and an electroshock self-defense weapon system, integrated in one plastic-type or metal-type housing 201, and the housing can be made with any suitable material, such as plastic or metal. The housing 201 has a shape adapted to secure a mobile device with the housing 201. In one embodiment, a user can activate the electroshock self-defense weapon system by pressing the activation button 202 to release the electroshock via electrodes 208. In some embodiments, the activation button 202 can be held down to release the electroshock. In some other embodiments, the activation button 202 can be clicked to turn on and off the electroshock self-defense weapon system. A device 200 includes a battery (not shown) within the housing 201 to supply electrical power to the self-defense weapon system.

In one embodiment, the electroshock weapon system can be activated by at least one of: (1) moving a safety switch and pressing an activation button, (2) depressing and moving a safety switch and pressing an activation button, (3) depressing a safety button or series of safety buttons and pressing an activation button, or (4) pressing an activation button.

In one embodiment, when a mobile device is attached and connected to the device 200, the mobile device sends a predetermined signal to the electroshock self-defense weapon system to release the electric shock. The predetermined signal can be generated by an application running on the mobile device. In another embodiment, the mobile device receives a remote instruction through a network, such as a cellular network, a WiFi network, or a Bluetooth connection. The mobile device converts the remote instruction to a predetermined signal and sends the predetermined signal to the electroshock self-defense weapon system to release the electric shock.

In one embodiment, the electroshock self-defense weapon system is capable of shooting a projectile which releases the electric shock when the projectile is in direct contact with a target. In some embodiments, the electroshock self-defense weapon system can emit a loud noise when releasing the electric shock. The weapon system can include a device such as a siren to emit noise. In another embodiment, the self-defense system is a non-lethal self-defense system including at least one of pepper spray, oleoresin capsicum, mace, tear gas, dye, pepper foam, stench ointment, personal alarm, or electroshock weapon.

In some embodiments, an electroshock module is integrated inside of a mobile device, instead of a housing of the mobile device. In another embodiment, a self-defense module includes a clip. The clip is designed to be attached to a case of a mobile device. Thus, the self-defense module can use the clip to attach to the case which in turn attaches to the mobile device. In one embodiment, the self-defense module is permanently fixed to the case. In another embodiment, the self-defense module is detachable from the case.

In one embodiment, the device 200 includes an LED light 203 to indicate that the safety switch 204 has been triggered and the device 200 is ready for activation. An additional LED light can also be included to display when the device is charging, has been charged or as a signal to recharge the device. In one embodiment, the safety switch can be an on/off switch. This switch can be moved linearly and prevents the device from incidentally discharging without a user's intent. In another embodiment, this switch can be replaced with a button. In some other embodiments, the safety mechanism can be in the form of a switch or multiple switches, a button or multiple buttons, a removable pin, a plastic cover, or another feature designed to prevent the electrodes from accidentally discharging.

In FIGS. 2B and 2C, the electrodes 208 are shown with an electrode cap 210 that can be placed on top of the electrodes 208. The electrode cap 210 serves as an additional form of safety and helps to further prevent incidental shock and discharge. The electrode cap 210 can be made of plastic, metal or other type of material and can be removable. In one embodiment, the electrode cap is attachable to the device 200.

In one embodiment, in order to use the device 200 for the intended use of personal defense, a user removes electrode cap 210 and slide safety switch 204 linearly from an 'off' position to an 'on' position. The LED light 203 turns on, indicating the self-defense weapon system is charged and is ready for use. After the activation button 202 is pressed, the self-defense weapon system delivers the electroshock via the electrodes 208. The electroshock is capable of incapacitating or shocking an attacking human or animal. After use, the device 200 can be turned off by sliding the safety switch 204 from the 'on' position to the 'off' position, and the electrode cap 210 can then be replaced to cover the electrodes 208.

In one embodiment, the device 200 provides a form fitted case which is integrated with an electroshock weapon system. The device 200 provides an electroshock weapon system that is placed on one side of a form fitted smartphone case. In another embodiment, the electroshock weapon system and the mobile device case are permanently integrated together. In yet another embodiment, the electroshock weapon system may be attached to and removable from the smartphone case by way of a clip, snap, screw, Velcro or other form of temporary attachment. In still another embodiment, a mobile device can slide into the case of the device 200 to permanently or temporarily attach to the case of the device 200.

The practicality and quick deployment potential of the device 200 makes it an advantageous tool for self-defense. A robber or attacker would not expect a mobile device case to deliver such an incapacitating shock. The device 200 effectively protects the user due to the ease of access and rapidity with which the device can be activated. In another embodiment, the device 200 is designed to deliver an electrical shock, surge, pulse, current or other type of self-defense action for the purpose of self-defense or personal protection.

Figure 3A:
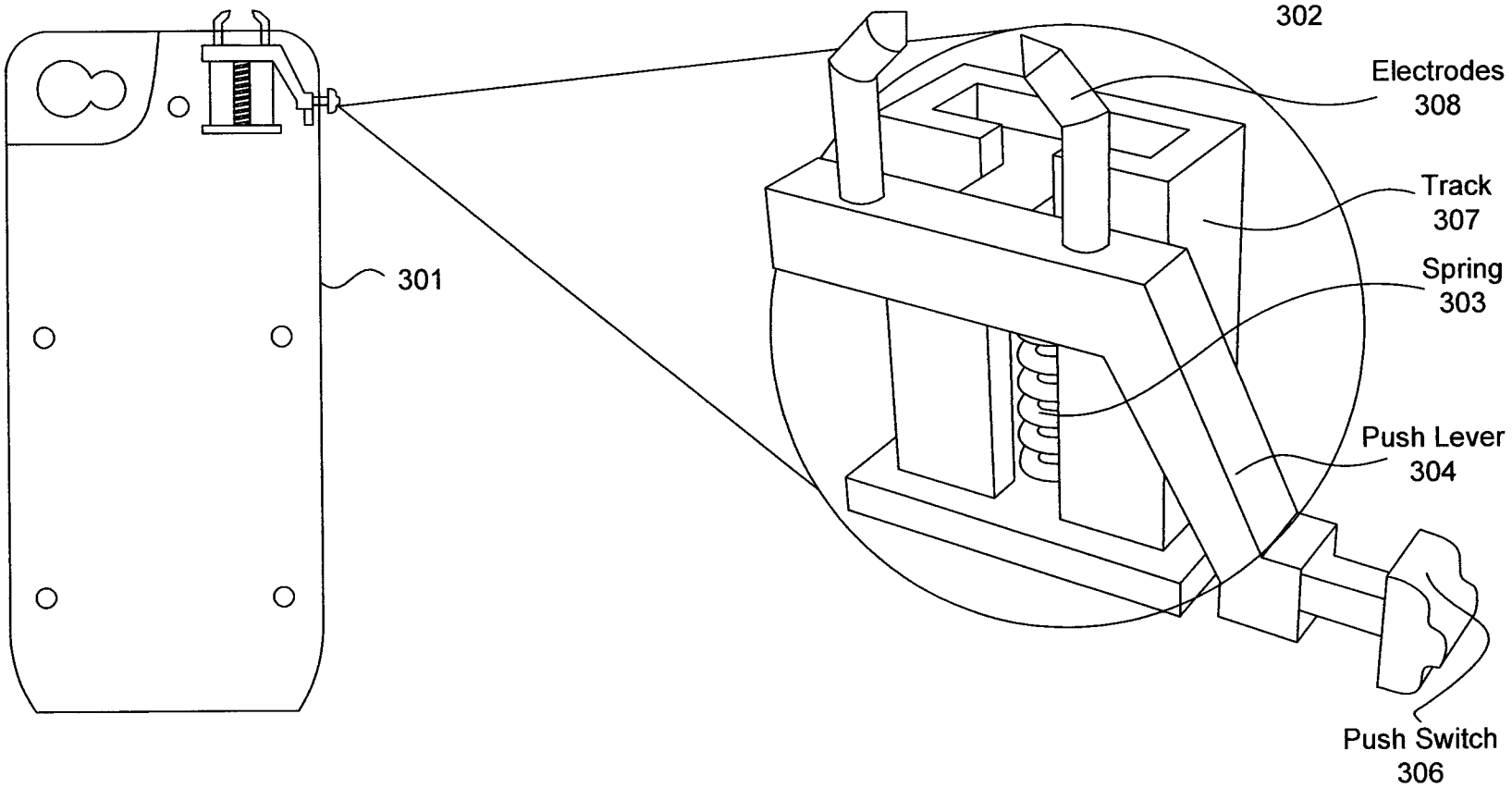
FIGS. 3A, 3B, 3C and 3D illustrate a sample electrodes ejecting mechanism.

FIG. 3A illustrates a sample electrode-ejecting mechanism, according to one embodiment of the present disclosure. As shown in FIG. 3A, an electroshock module includes electrodes 308 and a spring mechanism 302. The electrodes 308 are disposed within the housing 301 and are configured to release the electric shock. The spring mechanism 302 is capable of ejecting a portion of the electrodes 308 from the housing 301.

Figure 3B:
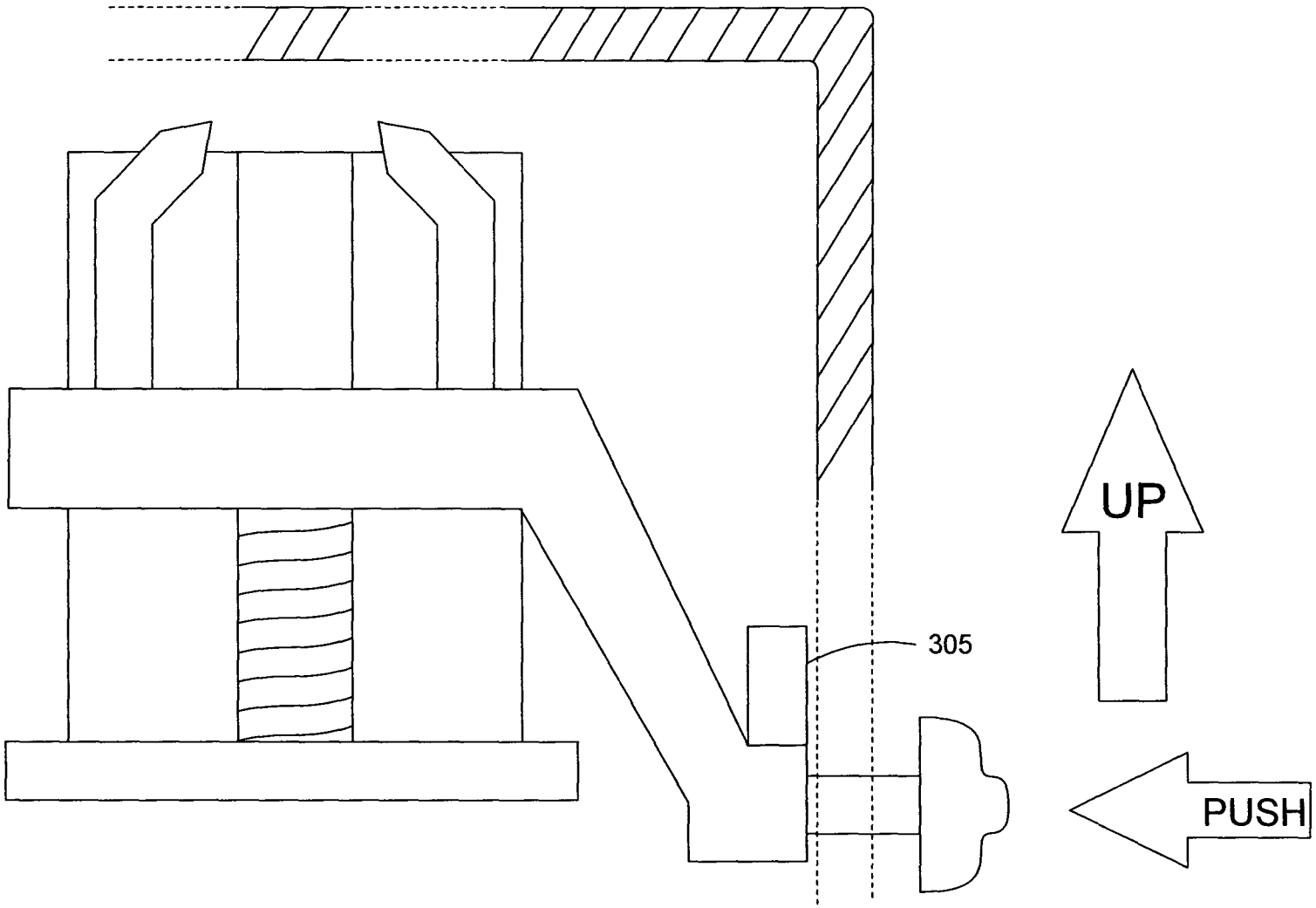
Figure 3C:
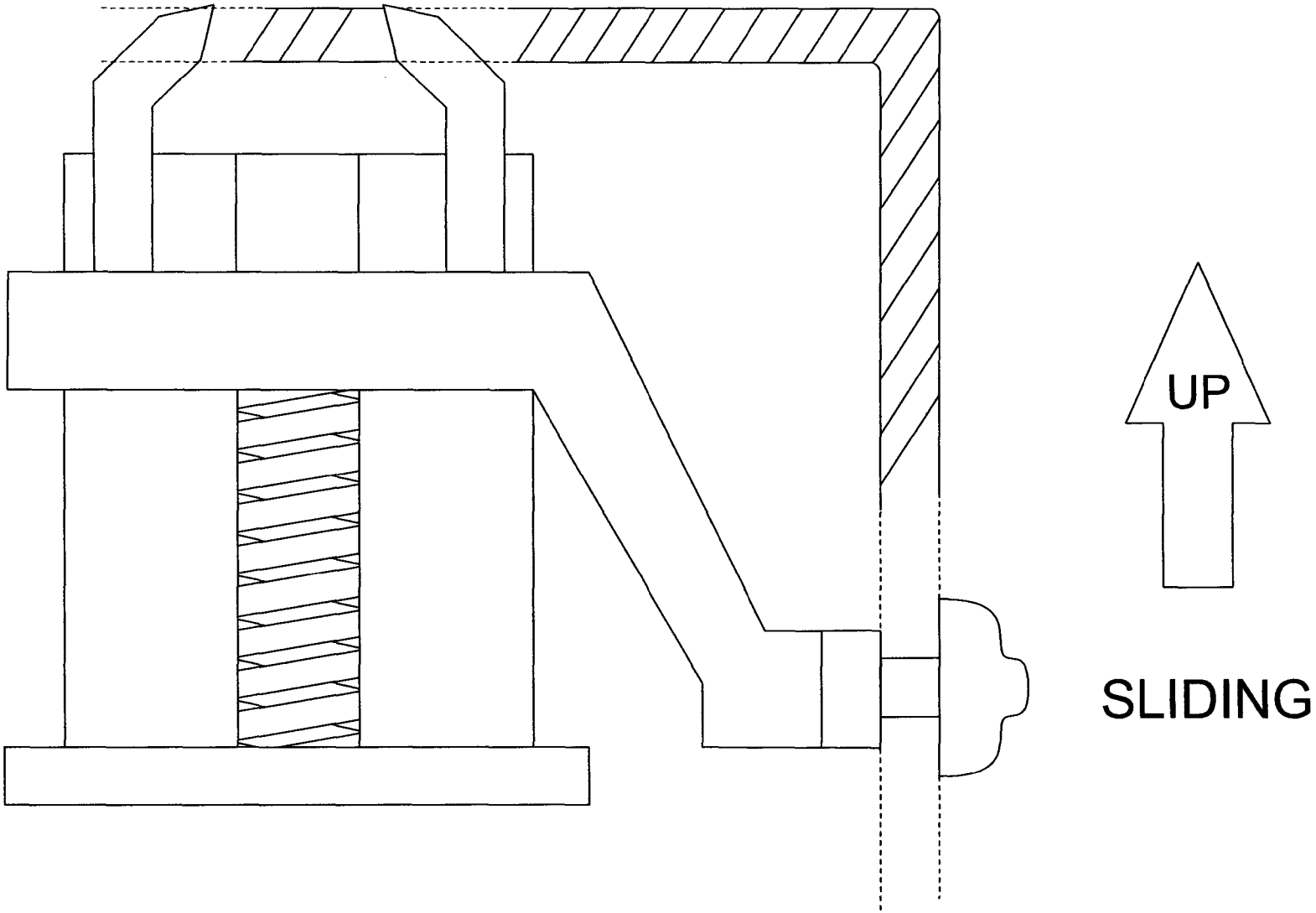
Figure 3D:
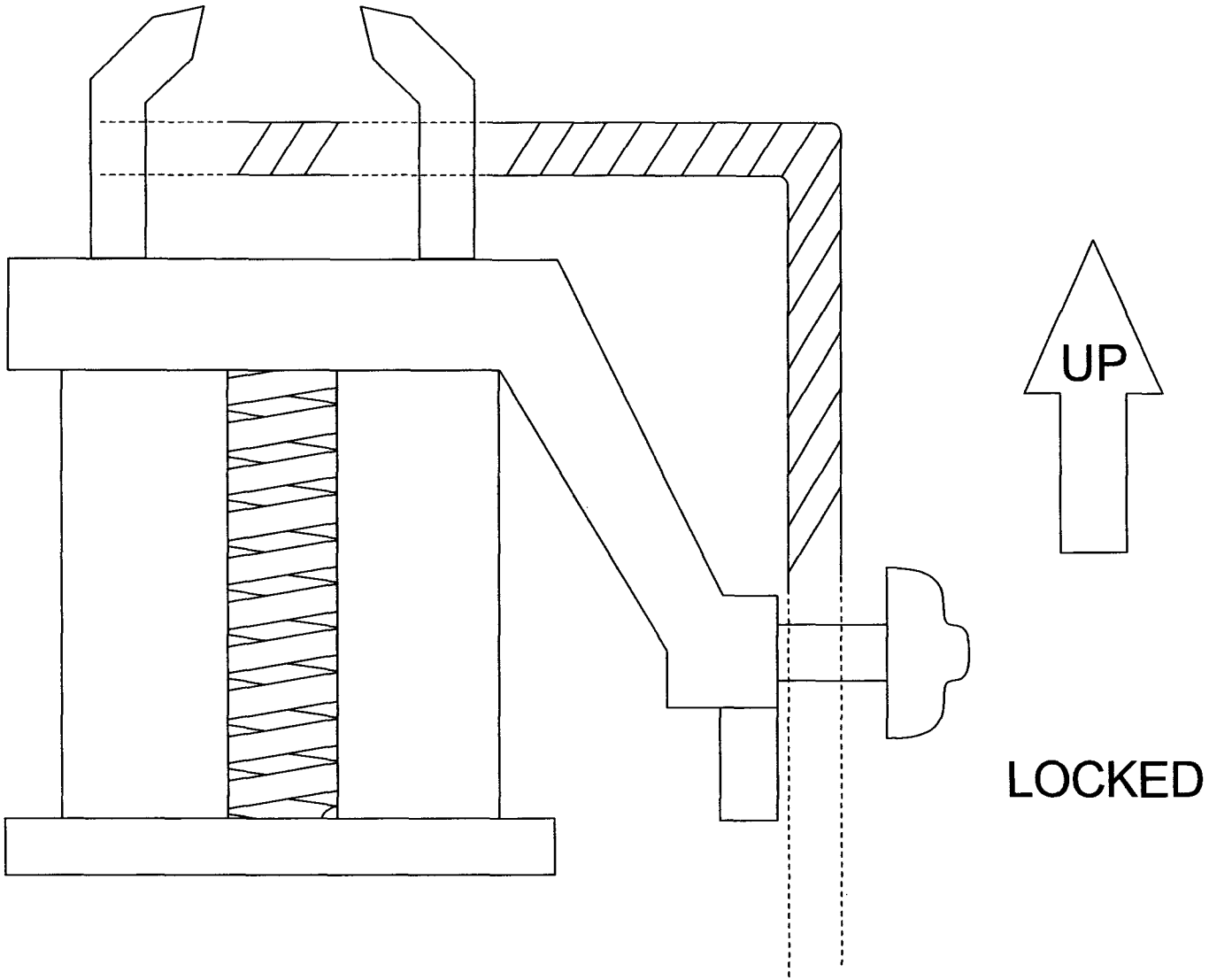

In one embodiment, the spring mechanism 302 includes a spring 303, a push lever 304, a locker 305, and a push switch 306. The push lever 304 is mechanically coupled to the electrodes and one end of the spring 303. The locker 305 locks the push lever 304 in a first position so that the spring 303 is compressed and the electrodes 308 are positioned within the housing 301, as shown in FIG. 3B. When the push switch 306 is pushed, the push lever 304 releases from the locker and slides up along a track 307, as shown in FIG. 3C. The push switch 306 is pushed to a second position by a decompression force of the spring 303, wherein the tips of the electrodes 308 protrude from the housing 301 when the push lever 304 is in the second position, as shown in FIG. 3D.

Figure 3E:
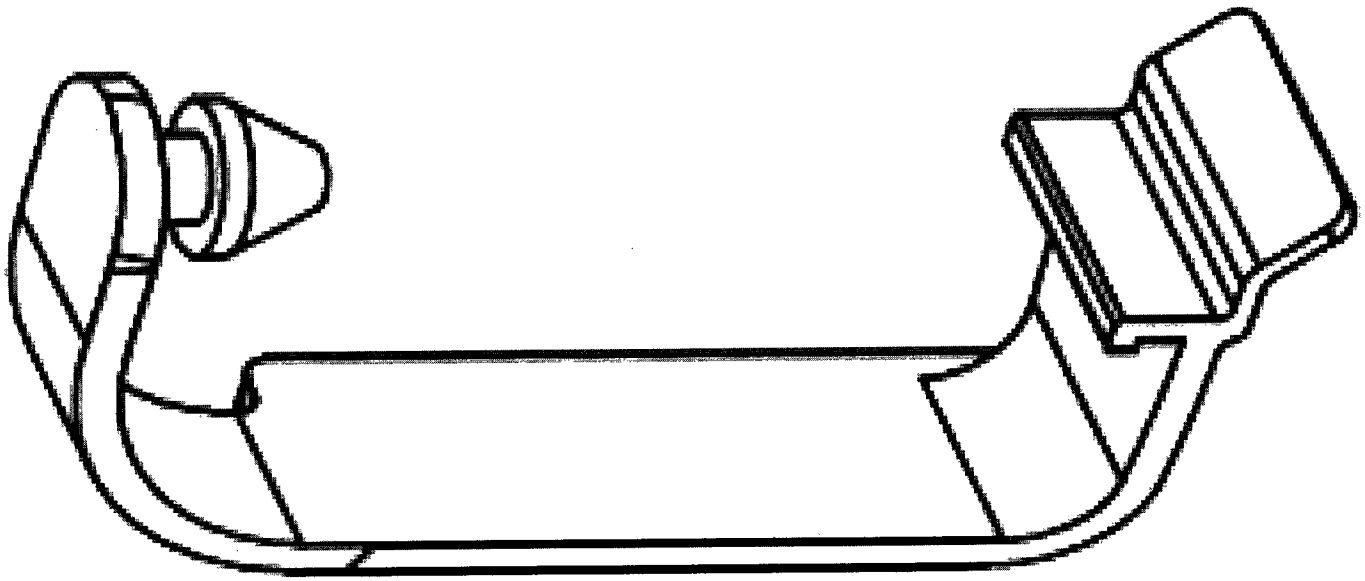
FIG. 3E shows a sample protective cap configured to cover electrodes of an electroshock module.

In another embodiment, the spring mechanism includes a spring and a protective cap. FIG. 3E shows a sample protective cap configured to cover the electrodes of the electroshock module. When the protective cap is in a closed position, the spring is compressed and the electrodes are positioned within the housing. When the protective cap is in an opened position, the tips of the electrodes protrude from the housing by a decompression force of the spring.

Figure 4:
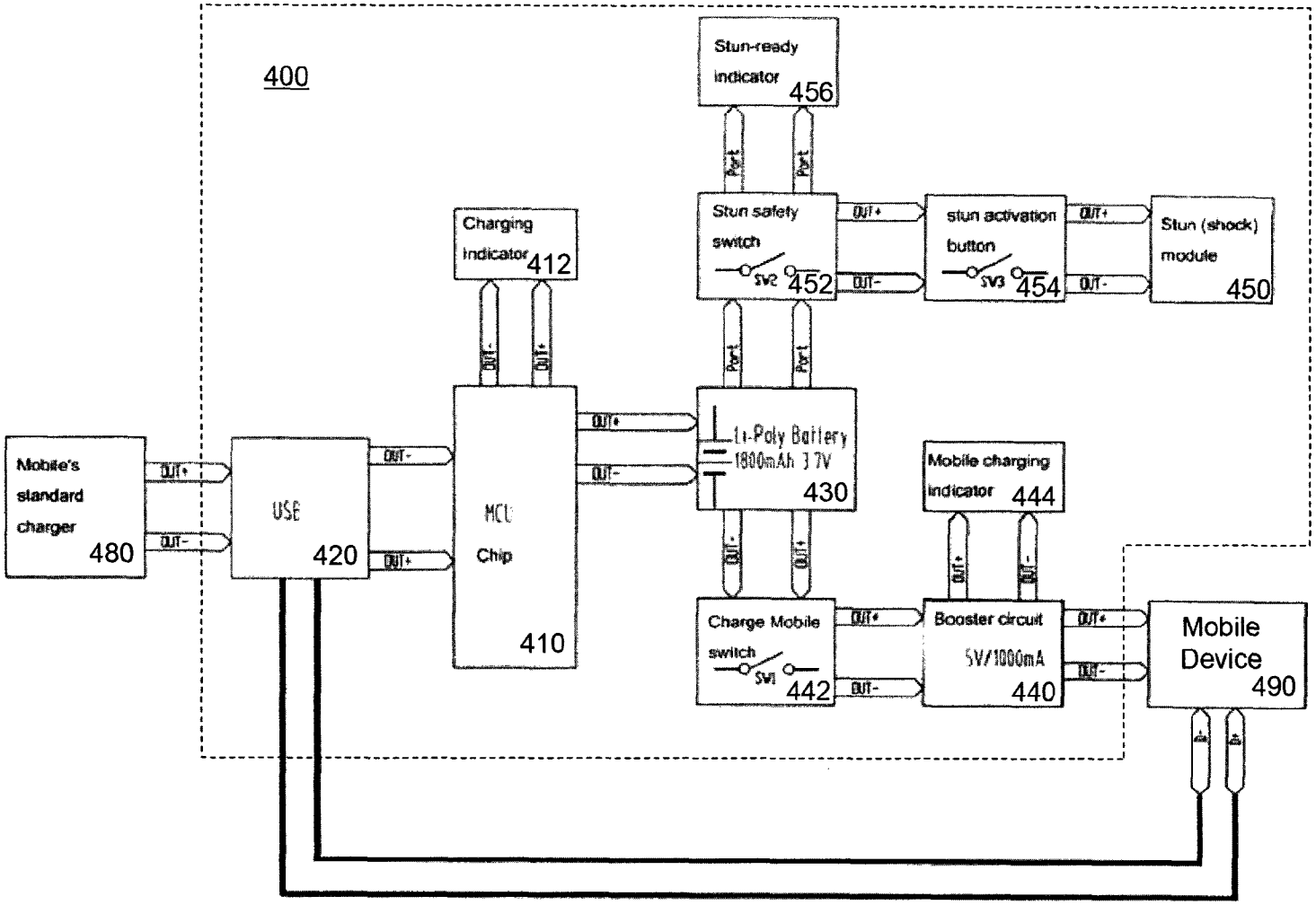
FIG. 4 illustrates a high level block diagram of electronic schematics of a self-defense device.

FIG. 4 illustrates a high level block diagram of the electronic schematics of a self-defense device 400. The self-defense device 400 can be attached to a mobile device 490. The device 400 includes a microcontroller unit (MCU) chip 410. The MCU chip 410 can have at least one built-in analog-to-digital (A/D) converter to detect charging current supplied from an external charger 480 via a charging interface 420 at any time. In one embodiment, the charging interface is a USB interface 420. The MCU chip 410 uses Pulse-width modulation (PWM) techniques to adjust the charging current to a constant current suitable for a built-in battery 430 and output the adjusted charging current to the battery 430. In one embodiment, the battery 430 is a Lithium Polymer battery rated at 3.7 V and 1800 mAh; and accordingly the charging current is about 1200 mA at a voltage of 4.5 V. However, a person of skill in the art would understand that the specifications of the battery and the provided charging current can be different.

The MCU chip 410 can further control a charging indicator 412 and a full charge indicator 414 (not shown in FIG. 4). For example, the MCU chip 410 can turn on an LED light as the charging indicator 412 when the MCU chip 410 is supplying charging current to the battery 430. Once the battery 430 is fully charged, the MCU chip 410 turns off the charging indicator 412 and turns on another LED light as the full charge indicator 414. In one embodiment, the MCU chip 410 prevents the battery 430 from supplying the electrical power to a mobile device 490 when a power level of the battery 430 is below a predetermined level.

The USB interface 420 can further include a data interface. Any data received on the data interface of the USB interface 420 will be relayed directly to the mobile device 490. When the mobile device 490 is attached to the self-defense device 400, a device interface of the self-defense device 400 detachably couples to an interface of the mobile device. The battery 430 is capable of supplying electrical power to the mobile device 490 via the device interface. The mobile device 490 can establish data communication with external devices through the USB interface 420 of the self-defense device 400.

In one embodiment, the battery 430 can connect to a booster circuit 440 via a charge mobile switch 442 between the battery 430 and the booster circuit 440. When the charge mobile switch 442 is off, the battery 430 does not supply electric current to the booster circuit 440. When the charge mobile switch 442 is on, the battery 430 supplies an electric current to the booster circuit 440. In one embodiment, electric current is supplied by the lithium polymer battery 430 at a voltage from 3.6 to 4.3 V. The booster circuit converts the electric current at 3.6 to 4.3 V to an output electric current of about 1000 mA at about 5 V which is suitable for the mobile device 490. The booster circuit is electrically connected to the mobile device 490 when the mobile device is attached to the self-defense device 400. The booster circuit draws the electrical power from the battery 430, converts it to an electrical current suitable for the mobile device 490, and supplies the converted electrical current to the mobile device 490. In one embodiment, the device 400 can further include a mobile charging indicator 444. When the booster circuit 440 supplies the electric current to the mobile device 490, the booster circuit 440 turns on the mobile charging indicator 444 to indicate that the self-defense device 400 is charging the mobile device 490.

The self-defense device 400 further includes a shock module 450 (also referred to as a stun module). In one embodiment, there are a stun safety switch 452 and a stun activation button 454 between the stun module 450 and the battery 430. The stun safety switch 452 is connected to a stun-ready indicator 456. When the stun safety switch is on, the battery 430 starts to charge a capacitor (not shown in FIG. 4). The capacitor builds up a charge from the electric current supplied by the battery 430. After the capacitor is charged, the stun-ready indicator turns on to indicate the stun module is ready to operate. If the stun activation button 454 is pressed, the shock module 450 will release electric pulses.

Figure 5:
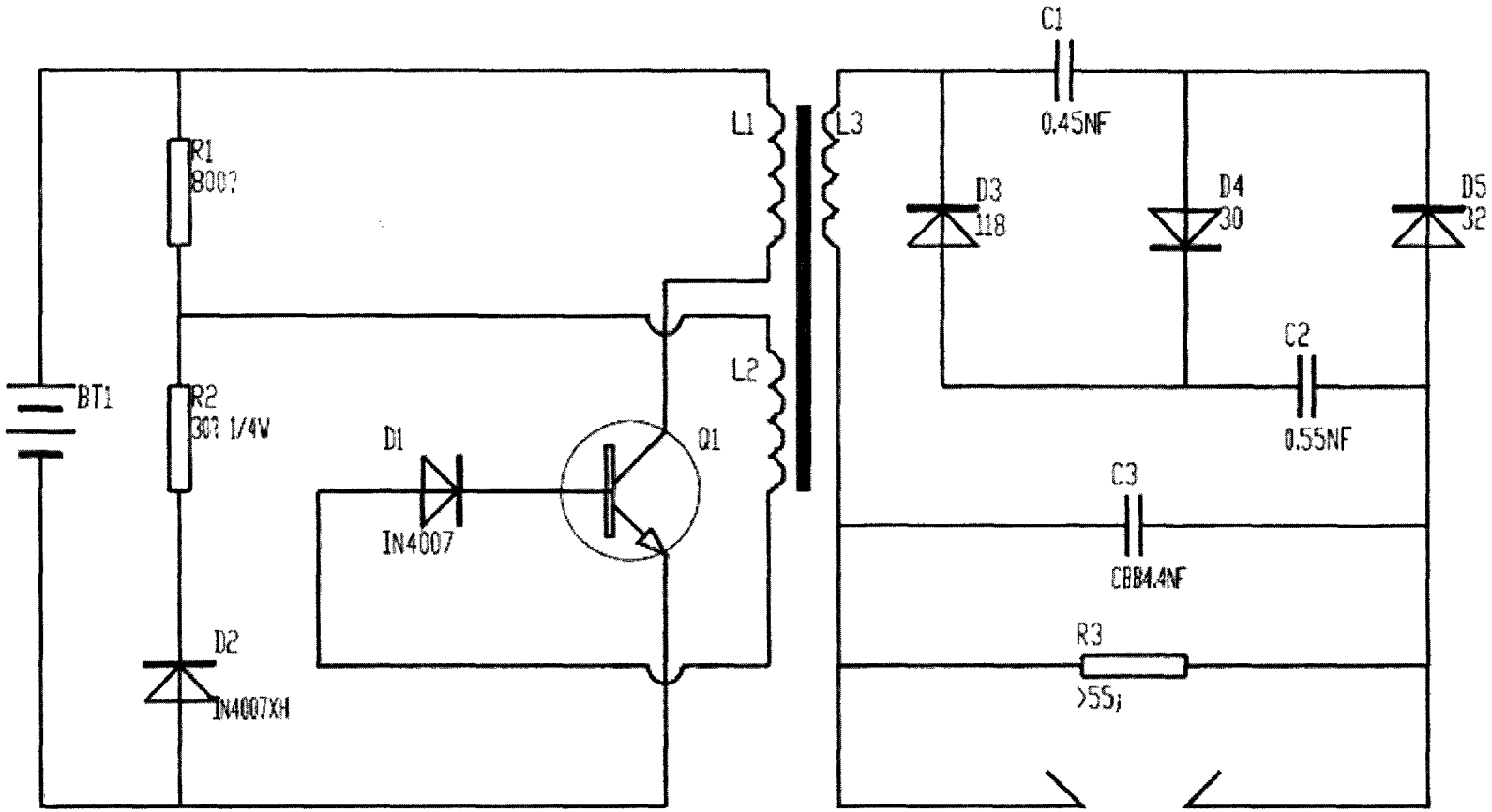
FIG. 5 is a sample circuit diagram for an electric shock portion of a self-defense device.

FIG. 5 is a sample circuit diagram for the electric shock portion of the self-defense device 400 (also referred to as the shock module). In one embodiment, the shock module includes two portions as shown in FIG. 5. The first portion is an autonomous booster circuit shown on the left side of FIG. 5. Primary transformer L1 provides a voltage equivalent to the voltage of the battery BT1. Transformer L2 and switch Q1 constitutes a self-oscillation feedback circuit. Accordingly a high volt pulse voltage is generated at the secondary transformer L3. The second portion is a triple voltage rectification circuit including diodes D3, D4, D5 and capacitors C1, C2, C3, as shown on the right side of FIG. 5. Through the triple rectification circuit, the high volt pulse voltage from L3 is increased three times at capacitor C3. Once the voltage at capacitor C3 is high enough (i.e. charged), the capacitor C3 is capable of breaking down air between two electrodes and delivering the electric shock. Resistance R3 is the internal discharge resistance. While FIG. 5 depicts an example circuit that can be used for the shock module, as will be appreciated by a person of skill in the art, modifications to the circuit are possible. For example, the rectification circuit can increase the high volt pulse voltage from L3 more or less than three times.

Figure 6:
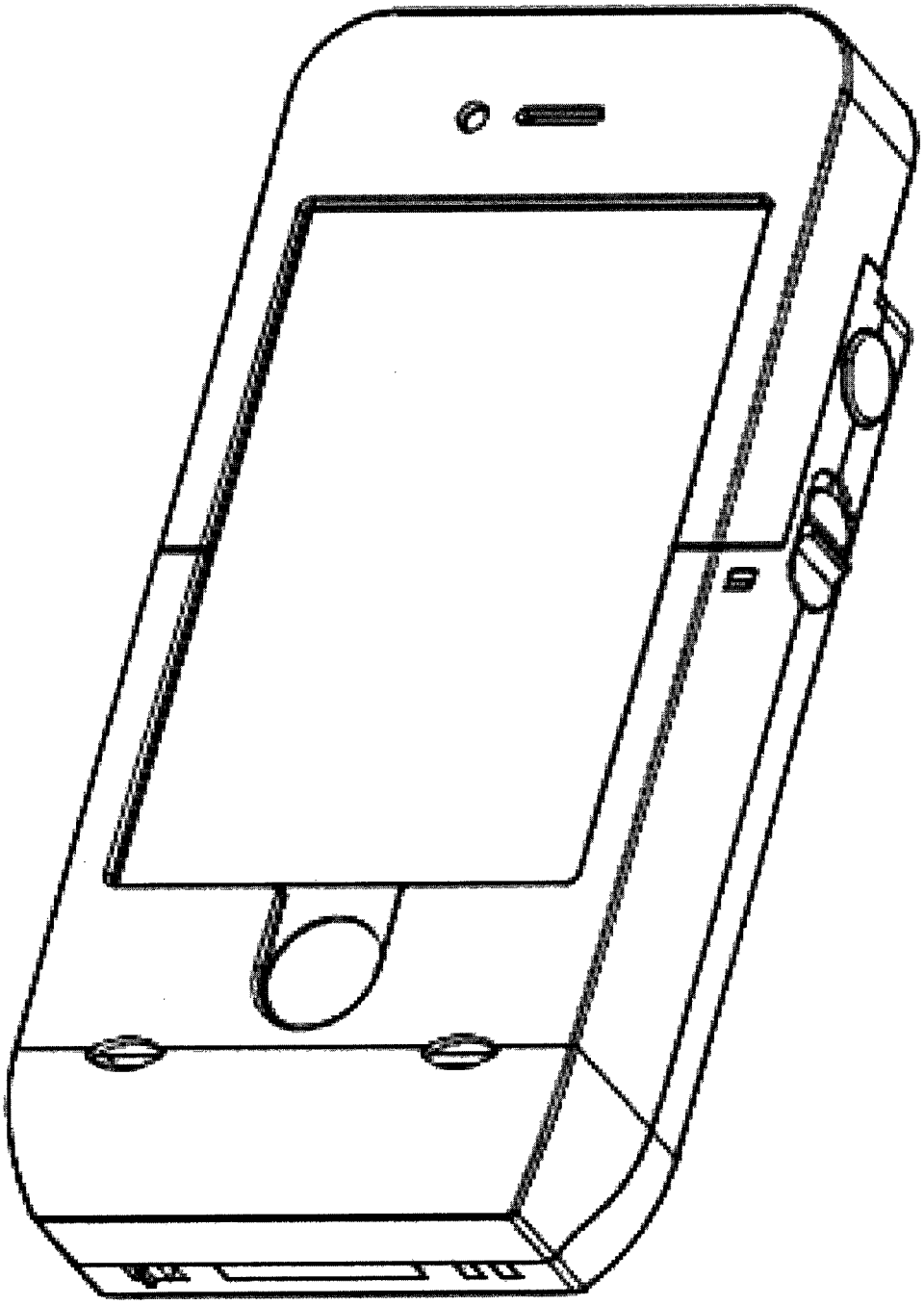
FIG. 6 illustrates a sample device including electric shock functionality.

FIG. 6 illustrates a sample device including the electric shock functionality. In one embodiment, the device illustrated in FIG. 6 can include a mobile device and a housing module attached to the mobile device. The housing module includes a shock module and a built-in battery as disclosed in previous paragraphs. In some embodiments, the housing module can have two portions. These two portions are designed to be slipped onto the mobile device and attached together on the mobile device by a clip.

Figure 7A:
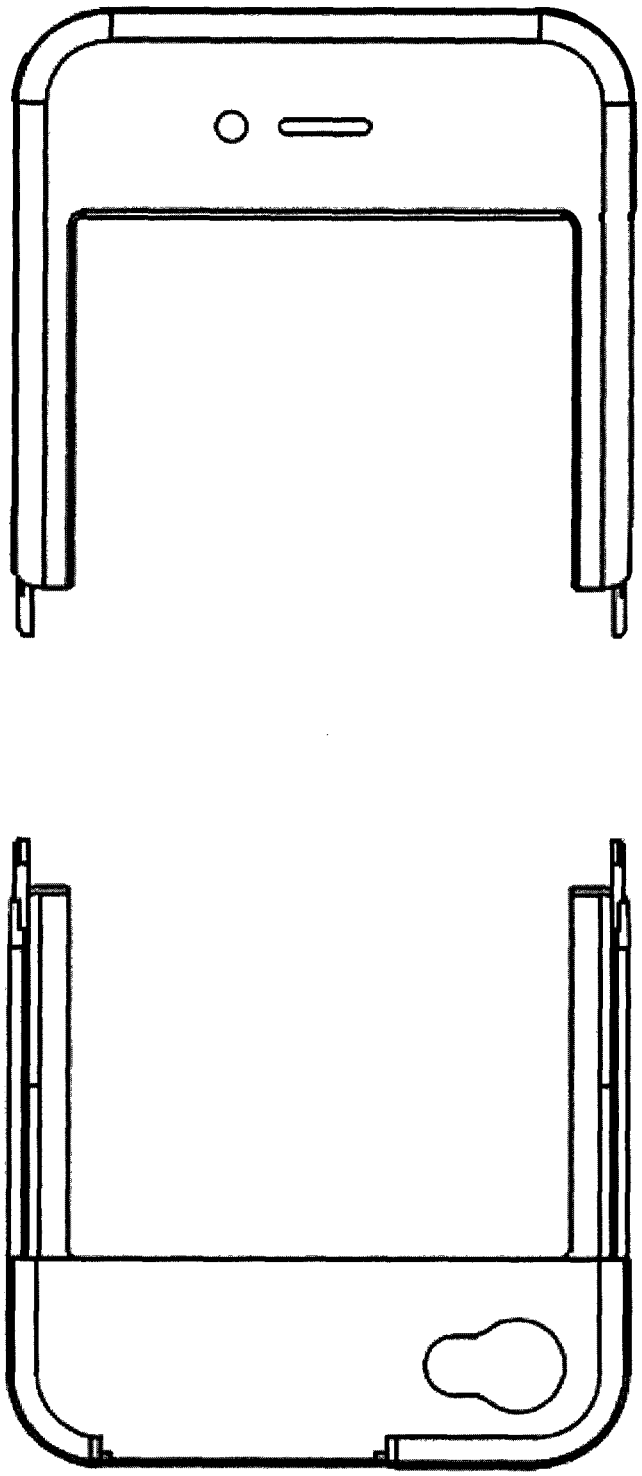
FIGS. 7A, 7B and 7C illustrate a sample housing module having a shock module and a built-in battery that include two portions.
Figure 7B:
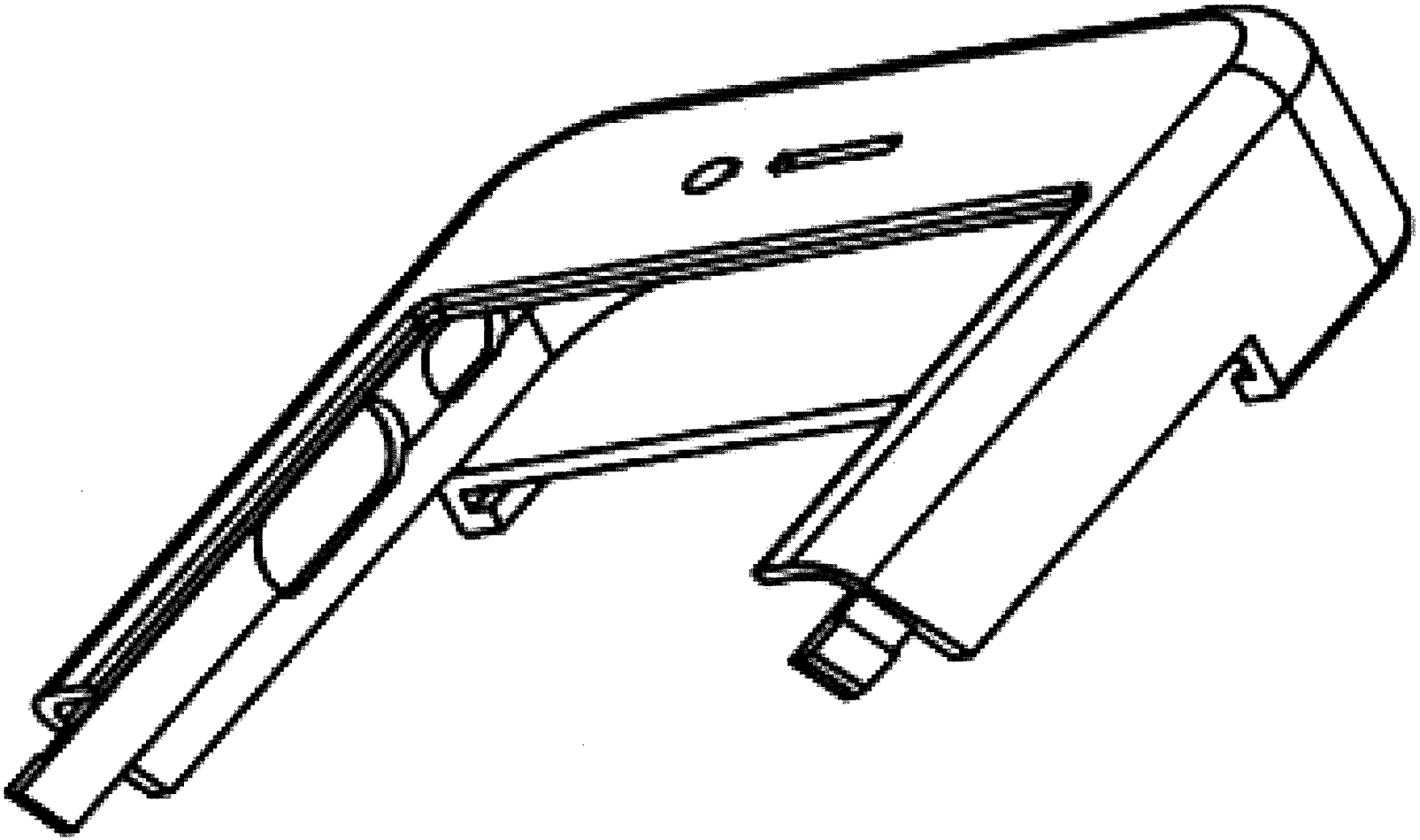
Figure 7C:
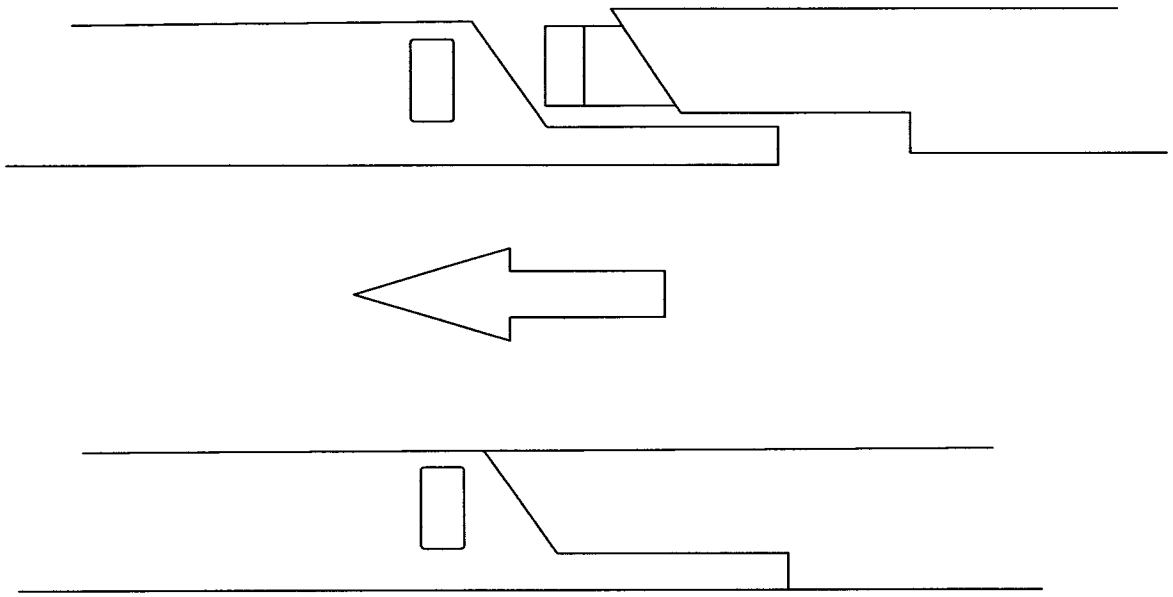

For example, FIG. 7A illustrates a sample housing module having a shock module and a built-in battery. FIG. 7B illustrates an additional perspective view of the upper portion of the housing. The sample housing module has two portions. And these two portions can be attached together by a mechanical interface. In one embodiment, the mechanical interface is one or more U-shaped clips that secure the two portions together by clipping one portion to another. As shown in FIG. 7C, the clips of the upper portion of the housing can slide into the lower portion of the housing. The clips snap into the lower portion and the two portions are mechanically secured together. In one embodiment, the shock module and the battery can both be included in one portion of the housing module. In another embodiment, the shock module is included in one portion of the housing module, and the battery is included in another portion of the housing module. In one embodiment, a self-defense module, such as the electroshock module, can be removably attached to a case that can be secured to a mobile device. For example, the self-defense module can be clipped to the case, screwed onto the case, or attached to the case magnetically. The electroshock module can include its own battery and electrodes. In addition to attaching to the case, the electroshock module can also electrically couple to the mobile device through a port of the mobile device so that the battery can charge the mobile device.

The removable electroshock module can also be interchangeable with other types of self-defense modules, such as pepper spray, oleoresin capsicum, mace, tear gas, dye, pepper foam, stench ointment, and/or a personal alarm. The other types of self-defense modules can be removably attached to the case in the same or a different manner from which the electroshock module attaches to the case. Further, more than one self-defense module can be attached to the case simultaneously.

Unless the context clearly requires otherwise, throughout the description and the claims, the words "comprise," "comprising," and the like are to be construed in an inclusive sense (i.e., to say, in the sense of "including, but not limited to"), as opposed to an exclusive or exhaustive sense. As used herein, the terms "connected," "coupled," or any variant thereof means any connection or coupling, either direct or indirect, between two or more elements. Such a coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. While processes or blocks are presented in a given order in this application, alternative implementations may perform routines having steps performed in a different order, or employ systems having blocks in a different order. Some processes or blocks may be deleted, moved, added, subdivided, combined, and/or modified to provide alternative or sub-combinations. Also, while processes or blocks are at times shown as being performed in series, these processes or blocks may instead be performed or implemented in parallel, or may be performed at different times. Further any specific numbers noted herein are only examples. It is understood that alternative implementations may employ differing values or ranges.

The various illustrations and teachings provided herein can also be applied to systems other than the system described above. The elements and acts of the various examples described above can be combined to provide further implementations of the invention.

Any patents and applications and other references noted above, including any that may be listed in accompanying filing papers, are incorporated herein by reference. Aspects of the invention can be modified, if necessary, to employ the systems, functions, and concepts included in such references to provide further implementations of the invention.

These and other changes can be made to the invention in light of the above Detailed Description. While the above description describes certain examples of the invention, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

While certain aspects of the invention are presented below in certain claim forms, the applicant contemplates the various aspects of the invention in any number of claim forms. For example, while only one aspect of the invention is recited as a means-plus-function claim under 35 U.S.C. §112, sixth paragraph, other aspects may likewise be embodied as a means-plus-function claim, or in other forms, such as being embodied in a computer-readable medium. (Any claims intended to be treated under 35 U.S.C. §112, ¶6 will begin with the words "means for.") Accordingly, the applicant reserves the right to add additional claims after filing the application to pursue such additional claim forms for other aspects of the invention.

In addition to the above mentioned examples, various other modifications and alterations of the invention may be made without departing from the invention. Accordingly, the above disclosure is not to be considered as limiting and the appended claims are to be interpreted as encompassing the true spirit and the entire scope of the invention. For example, the battery in the housing can charge the electroshock module without electrically coupling to the mobile device when the housing is attached to the mobile device. In another embodiment, the schematics 400 or a portion thereof can be integrated directly into the electronics of the mobile device itself, rather than being external to the mobile device in a housing, and the mobile device can include an application for controlling the electroshock module. In one embodiment, the mobile device can receive a predetermined signal remotely or from the housing to charge and release an electric shock from the electroshock module.

What is claimed is:

1. An apparatus for a mobile device, the apparatus comprising:

a housing having a shape adapted to secure the mobile device with the housing;

an electroshock module within the housing configured to release an electric shock, wherein the electroshock module includes electrodes disposed within the housing and configured to release the electric shock;

a spring capable of ejecting a portion of the electrodes from the housing; and, a protective cap, wherein when the protective cap is in a closed position, the spring is compressed and the electrodes are positioned within the housing, and when the protective cap is in an opened position, the tips of the electrodes protrude from the housing by a decompression force of the spring; and, a battery within the housing configured to supply electrical power to the electroshock module and the mobile device.

2. The apparatus of claim 1, further comprising:

a push lever mechanically coupled to the electrodes and one end of the spring;

a locker that locks the push lever in a first position so that the spring is compressed and the electrodes are positioned within the housing; and, a push switch, wherein when the push switch is pushed, the push lever releases from the locker and is pushed to a second position by a decompression force of the spring, wherein tips of the electrodes protrude from the housing when the push lever is in the second position.

3. The apparatus of claim 1, further comprising an activator, wherein the electroshock module prepares to release the electric shock when the activator is activated.

4. The apparatus of claim 3, wherein the activator is a button, lever, or switch.

5. The apparatus of claim 1, further comprising a safety mechanism to prevent a user from inadvertently releasing an electric shock.

6. The apparatus of claim 1, further comprising a charging interface configured to charge the battery.

7. The apparatus of claim 1, further comprising a microprocessor configured to control the charging of the battery.

8. The apparatus of claim 7, wherein the microprocessor stops the battery from supplying the electrical power to the mobile device when a power level of the battery is below a predetermined level.

9. The apparatus of claim 1, further comprising a charging indicator configured to indicate a charging status of the battery.

10. The apparatus of claim 1, further comprising a device interface configured to detachably couple to a charging interface of the mobile device, wherein the battery is capable of supplying electrical power to the mobile device via the device interface.

11. The apparatus of claim 1, further comprising a power converter configured to convert an electric current supplied by the battery at a battery voltage level to a charging voltage level for the mobile device.

12. The apparatus of claim 1, wherein the electroshock module is configured to shoot a projectile which releases the electric shock when the projectile is in contact with a target.

13. The apparatus of claim 1, wherein the electroshock module includes a capacitor configured to build up a charge from electric current supplied by the battery.

14. The apparatus of claim 1, further comprising a flashlight within the housing, the flashlight powered by the battery.

15. The apparatus of claim 1, wherein the electroshock module is further configured to emit a loud noise when releasing an electric shock.

16. An apparatus for a mobile device, the apparatus comprising:

a housing having a shape adapted to secure the mobile device with the housing;

an electroshock module within the housing configured to release an electric shock;

a battery within the housing configured to supply electrical power to the electroshock module and the mobile device; and, a second housing portion, wherein the housing and the second housing portion secure to the mobile device through a U-clip mechanism that interconnects the housing and the second housing portion.

17. The apparatus of claim 16, further comprising an activator, wherein the electroshock module prepares to release the electric shock when the activator is activated.

18. The apparatus of claim 16, further comprising a safety mechanism to prevent a user from inadvertently releasing an electric shock.

19. The apparatus of claim 16, further comprising a charging interface configured to charge the battery.

20. The apparatus of claim 16, further comprising a microprocessor configured to control the charging of the battery.

21. The apparatus of claim 20, wherein the microprocessor stops the battery from supplying the electrical power to the mobile device when a power level of the battery is below a predetermined level.

22. The apparatus of claim 16, further comprising a charging indicator configured to indicate a charging status of the battery.

23. The apparatus of claim 16, further comprising a device interface configured to detachably couple to a charging interface of the mobile device, wherein the battery is capable of supplying electrical power to the mobile device via the device interface.

24. The apparatus of claim 16, further comprising a power converter configured to convert an electric current supplied by the battery at a battery voltage level to a charging voltage level for the mobile device.

25. An apparatus for a mobile device, the apparatus comprising:

a housing having a shape adapted to secure the mobile device with the housing;

an electroshock module within the housing configured to shoot a projectile which releases an electric shock when the projectile is in contact with a target; and, a battery within the housing configured to supply electrical power to the electroshock module and the mobile device.

26. An apparatus comprising:

a mobile device;

a housing having a shape adapted to secure the mobile device within the housing;

an electroshock module within the housing configured to release an electric shock when the mobile device receives a remote instruction through a network; and, a battery within the housing configured to supply electrical power to the electroshock module and the mobile device.

27. An apparatus comprising:

a mobile device;

an electroshock module integrated inside the mobile device and configured to release an electric shock via electrodes when the mobile device receives a remote instruction through a network; and, the electrodes configured to emerge from a housing of the mobile device to release the electric shock.

* * * * *